United States Patent [19]

Yasutake et al.

[11] 4,286,837

[45] Sep. 1, 1981

[54] ELECTRICAL CONNECTOR, AN INSULATOR THEREFOR AND A FITTING JIG FOR AN ASSEMBLY OF THESE

[75] Inventors: Kenichi Yasutake; Tetsuji Watanabe, both of Yokohama, Japan

[73] Assignee: K.K. Elco International, Yokohama, Japan

[21] Appl. No.: 103,610

[22] Filed: Dec. 14, 1979

[30] Foreign Application Priority Data

Dec. 25, 1978 [JP] Japan ..... 53-158670

[51] Int. Cl.[3] ..... H01R 9/09

[52] U.S. Cl. ..... 339/176 MP; 339/221 R

[58] Field of Search ..... 339/17 L, 17 C, 17 LC, 339/75 MP, 221 R, 221 M, 176 MP, 217 R, 217 S; 29/741, 769, 884

[56] References Cited

U.S. PATENT DOCUMENTS

| | | | |
|---|---|---|---|
| 3,530,422 | 9/1970 | Goodman | 339/17 |
| 3,676,926 | 7/1972 | Kendall | 29/625 |
| 3,769,679 | 11/1973 | Kendall | 29/203 B |
| 3,837,063 | 9/1974 | Wright | 29/203 P |
| 3,866,997 | 2/1975 | Kreutter et al. | 339/217 S |
| 3,883,207 | 5/1975 | Tomkiewicz | 339/75 M |

FOREIGN PATENT DOCUMENTS

| | | | |
|---|---|---|---|
| 2006465 | 12/1970 | Fed. Rep. of Germany | 339/217 S |

*Primary Examiner*—Eugene F. Desmond

*Attorney, Agent, or Firm*—Meyer, Tilberry & Body

[57] ABSTRACT

An elongated electrical connector, elongated insulator block for holding several of the connectors and a jig or tool for assembling the block and connectors to a printed circuit board. The connectors are each provided with an intermediate mounting boss or plate with an opening that matches an opening in the side of the elongated block. The jig includes a series of movable claws which extend into the connector openings to align the connectors and drive them into matching apertures of a printed circuit board.

7 Claims, 3 Drawing Figures

ELECTRICAL CONNECTOR, AN INSULATOR THEREFOR AND A FITTING JIG FOR AN ASSEMBLY OF THESE

The present invention relates to the art of multiple connector receptacles or sockets for printed circuit boards and more particularly to a novel connector, insulator block for supporting several of these connectors and a jig or tool for aligning the connectors in the block and then inserting the assembled connectors onto a printed circuit board.

BACKGROUND OF INVENTION

This invention relates to an electrical connector for press fitting into a printed circuit board, an insulator block to accommodate several of these connectors and a jig to connect an assembly of the connectors and insulator block to a printed circuit board.

Where it is desired to have a large number of connections to a printed circuit board, there are generally provided a number of elongated electrical connectors. Each of the connectors is assembled to a portion of the printed circuit to attain an electrical connection and a mechanical connection between the printed circuit board and each connector. This connection is often obtained by way of spring characteristics of that portion of the connector inserted into a hole of the printed circuit board. The connector is forced into a hole in the board to retain a fixed mechanical connection. Often a wire is used to obtain the electrical connection; however, this is not always used. In such an arrangement, inspection of the connectors and insulator blocks must be done separately for each of these components at the time of shipping and after receipt thereof. This involves a number of complicated procedures for inspection. When considered from the viewpoint of quality control of the total electrical connector assembly substantial effort is required. The individual connectors and insulator blocks are separately supplied. The user must then assemble these components. Due especially to the small size of the connectors, many problems are experienced. There are problems in assuring quality of the assembly, such as a problem of maintaining the connectors in an accurately aligned condition during assembly to the printed circuit board. Further, there is additional work on the part of the user to assemble the connectors to the insulator. This is a tedious task. If a jig or tool is required to assemble the connectors, the jig itself is quite complicated in structure to attain a high degree of assembly precision. Consequently, the jig to assemble connectors into the insulator block or socket is expensive. The present invention provides an electrical connector and block assembly and a jig for mounting the assembly on a printed circuit board that solve these problems.

In accordance with the present invention, there is provided an electrical connector for press fitting into a printed circuit board. The connector is stamped from a sheet metal blank having spring characteristics into an elongated and narrow structure. The generally middle part of the connector is formed into a rectangular shape. A spring portion is provided below the rectangular portion and a bar shaped portion for connection to a printed circuit board extends downwardly from below the spring portion. A strip shaped upper half of the connector above the rectangular portion is the part of the connector which is retained within the insulator block. The strip portion immediately above the rectangular portion has a curvature of small radius, followed by an inclined portion from which there extends a curved portion of large radius to form a contact portion of the connector.

The substantially central area of the intermediate rectangular portion of the electrical connector described above is blanked to form an insertion hole of polygonal, circular or oval shape. A claw of a jig constructed in accordance with another aspect of the present invention and described later enters into this hole to ensure that force used to insert the end of the connector into a printed circuit board is applied to the connector at the middle of the connector and along the axis of the bar shaped end portion of the connector. On one side of the intermediate rectangular portion, at an upper centrally located portion thereof, there is formed a protrusion having a sharp edge which cuts into the plastic body of the receiving insulator block to hold the connector firmly in the block.

Below the intermediate rectangular portion of the connector, and by way of a constricted portion, there is provided a spring portion having a lateral width slightly smaller than that of the intermediate rectangular portion, and a circular or oval hole may be formed centrally of the spring portion to allow spring gripping with the printed circuit board.

The connector as defined above can be forced into a channel or slot in the insulator block with the intermediate rectangular portion performing different functions. This portion is flat and coacts with a plane surface in the block to orientate the connector with respect to the block. Upper, transversely spaced shoulders on this portion, which is larger than the end of the connector located in the upper socket area of the block, abut the inward ends of spaced grooves in the mounting slot for a connector in the block. This abutting action locates the connector axially in the block and the two spaced shoulders stabilize the vertical alignment of the extending end of the connector. By providing a sharp edge to cut into the insulator block when the connector is forced into a receiving slot of the block, the connector is prevented from inadvertent withdrawal from the block. When several connectors are so secured, the block is held firmly on the printed circuit board by the interaction of all connectors with the block.

In accordance with an aspect of the invention, the connectors are provided with aligning and assembly openings which are preferably in the flat intermediate boss or plate. By inserting interconnected claws of a jig into these openings through clearance openings in the side or sides of the insulator block, the connectors are fixedly aligned by claws and the connectors can be driven into apertures on the printed circuit boards by forcing the claws toward the board. The extended ends are aligned with the intermediate portion so that the insertion force is in a straight line along the longitudinal axes of all outwardly extending ends of the respective connectors.

The present invention further includes an insulator body or socket which has slots to accomodate two generally parallel rows of connectors of the kind described above. Such insulator socket is formed as a block which is elongated in its lateral direction and has sufficient thickness or width to support pairs of transversely spaced connectors. A lateral groove is formed centrally of the insulator block. The depth of this groove is slightly greater than one half the height of the block and the upper portion of this groove is open outwardly and upwardly to define a socket area for subsequent connection of a contact head. A triangular cross sectioned guide portion is positioned below the opened groove. A series of partition walls with a given distance therebetween are located internally of the insulator block to define slots for accepting the several connectors and separating the upper contact portions of the connectors. At the lower end of the partition walls, there are provided a vertical groove for receiving a shoulder of the intermediate rectangular portion of a connector and a connector retaining portion. A guide of an inverted triangular shape is provided to facilitate insertion of the connector and to securely retain the connector in the insulator block. A series of slots or side openings are formed at lower portions on both sides of the block for insertion of the claws of a fitting jig to engage and align connectors in said block. The insulator block just described may be made of insulating plastic material in one piece.

This invention further provides a jig for mounting to a printed circuit board an assembly formed by inserting the above described connectors into the insulator block just explained. This jig is made of a metal material and has a pair of end walls connected by a central wall. A pair of fitting walls are mounted onto the opposite sides of the central wall at a suitable distance. A series of claws projecting from these fitting walls toward the central wall are provided at the lower portion of each fitting wall. The end portion of each claw is appropriately shaped to match the shape of an insertion hole of a connector. The upper part of the fitting wall is connected to the central wall by means of springs, with a pivotal mounting projection of the central wall fitting into a recess of the fitting wall. The parts of the fitting jig are so designed that as upper portions of the fitting walls are pressed toward each other, the lower portions of the fitting walls open. The claws can be inserted into slots or side openings of the insulator block. When the force applied to the upper portions of the fitting wall is released, the claws move through the slots or side openings of the block and then enter into the insertion holes of the intermediate rectangular portions of the individual connectors. Since the lower portions of the end walls are connected to two low base elements by springs, the connector assembly held by the jig can be attached to the printed circuit board by pressing the movable portion of the fitting jig and the assembly carried by the claws of the fitting walls on the movable portion toward the printed circuit board. When the assembly is attached to the board, the upper portions of the fitting walls are pressed together to release the claws from the assembly. Then the jig is removed.

The primary object of the present invention is to provide an elongated printed circuit board type connector, an insulating socket block for receiving several of the connectors and a jig or tool for attaching the socket block and connectors onto a printed circuit board, which components are easy to assemble and use, provide aligned connectors for presentation to the board, and exert attaching forces only through the elongated connectors.

Another object of the present invention is the provision of an elongated connector, socket block and tool as defined above, which components employ an opening in the connector for engagement with an element on the tool for applying an attaching force between the tool and connector after the connector is assembled onto the socket block.

Still a further object of the present invention is the provision of components as defined above, which components reduce the effort in assembling connectors or socket blocks and in attaching the connectors onto a printed circuit board.

These and other objects and advantages will become apparent after consideration of this disclosure which includes the accompanying drawings:

PREFERRED EMBODIMENT

The invention will now be described in detail by way of reference to the attached drawings, but it should be understood that the drawings are for reference purpose only and are not intended to limit the invention to the embodiment shown.

Figure 1:
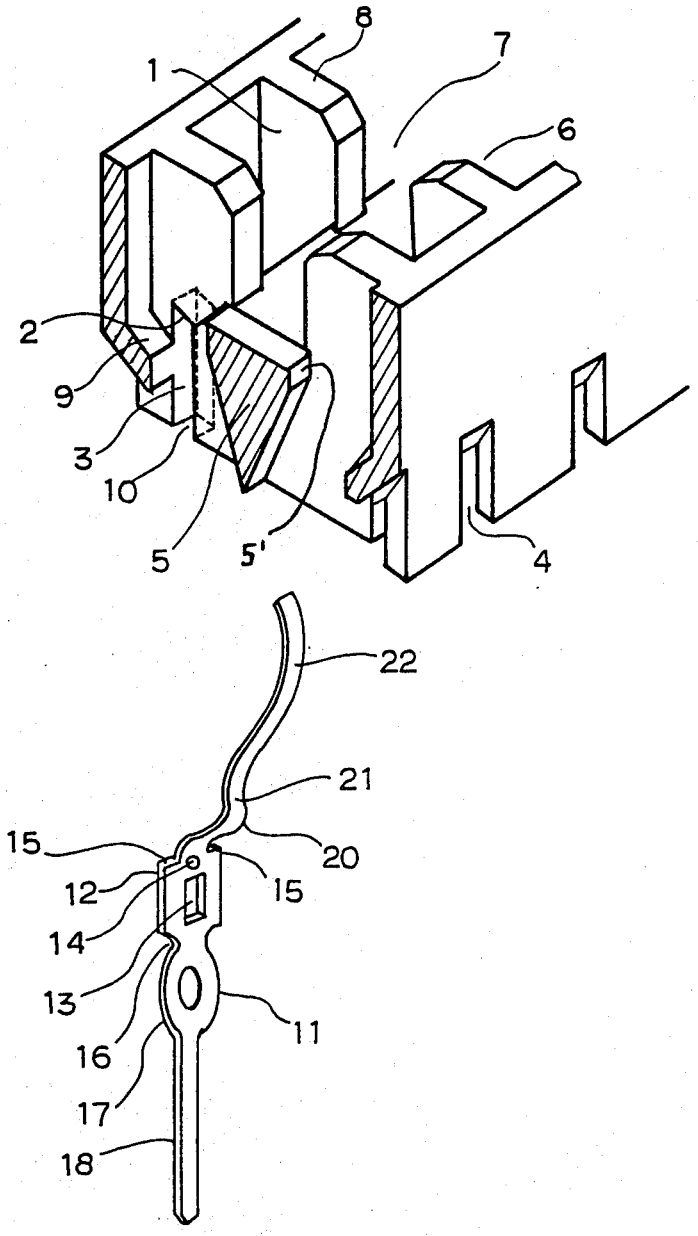
FIG. 1 is a pictorial view showing a connector in the lower portion and a cross-sectioned insulator block or socket in the upper portion.
Figure 2:
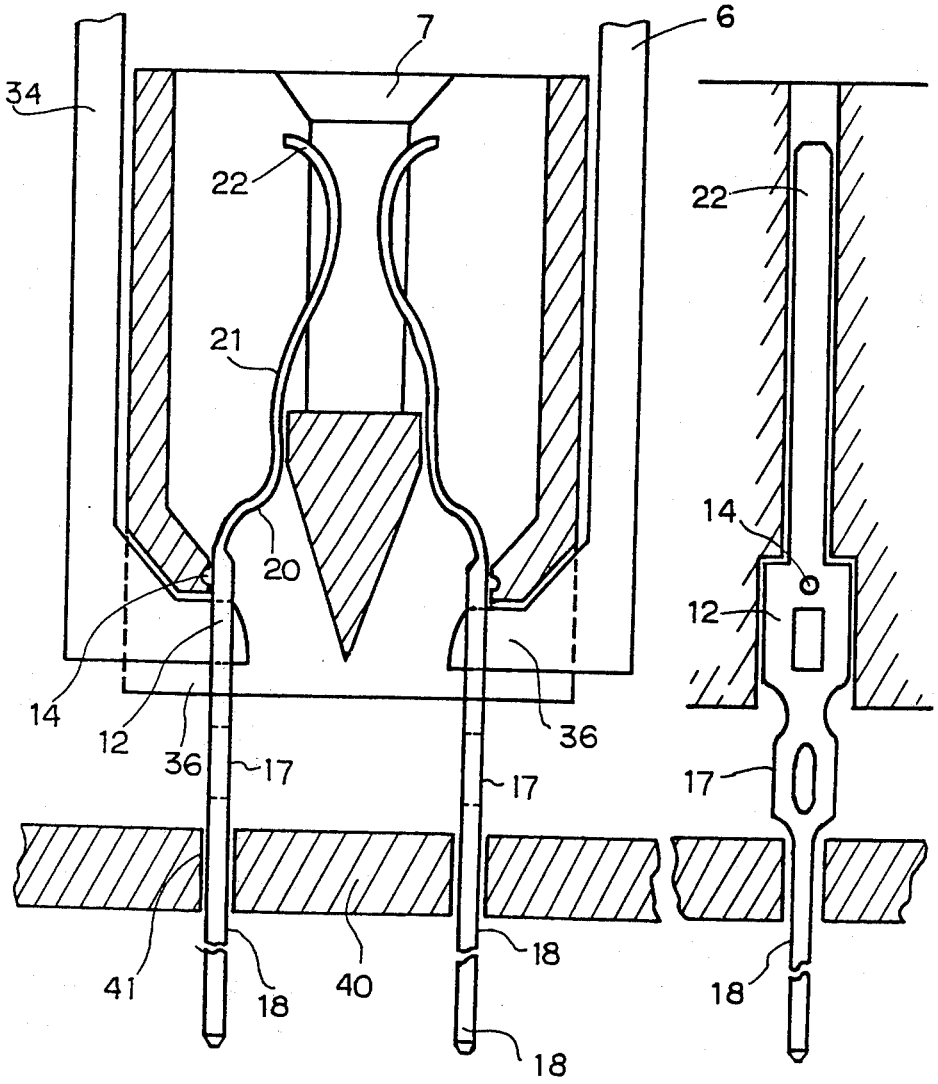
FIG. 2 is an enlarged generally cross-sectioned view having a left portion illustrating two connectors in a transversely cross-sectioned insulator block with a portion of the attaching tool and printed circuit board and a right portion illustrating a part of a longitudinally cross-sectioned insulator block with a connector in its assembled position; and, FIG. 3 is a pictorial view of the attaching jig or tool with an intermediate portion removed.

An electrical connector 11 for assembly to a printed circuit board and insulator socket and constructed according to the present invention is shown in FIGS. 1 and 2. Electrical connector 11 is stamped from a sheet metal blank having spring characteristics and is provided with an intermediate rectangular portion or flat boss or tab 12 substantially at its middle. The central portion of the rectangular boss 12 is blanked to present an insertion hole 13 of generally rectangular shape. As seen in the drawings, upper side portions of rectangular boss or tab 12 are formed as abutment shoulders 15. A constriction 16 is formed below the rectangular boss. Below constriction 16, there is provided a spring or deflectible portion 17. The central part of spring portion 17 is blanked to form a circular or oval hole to give connector 11 good spring characteristics. Spring portion 17 while making a good electrical connection to a through hole 41 of a printed circuit board 40, offers good mechanical connection when connector 11 is assembled to insulator block or socket 6. A lateral width of the spring portion 17 is slightly smaller than that of rectangular portion 12. The lower part of the spring portion 17 extends straight downwardly to form a bar 18 of substantially rectangular cross-section. A lateral width of the bar 18 is smaller than that of spring portion 17. A wire may be wrapped around the bar 18 to form an electrical connection with the connector.

The upper half of connector 11 has a lateral width smaller than that of the rectangular portion but larger than that of the bar 18 and is formed as a strip. At the side of rectangular portion or boss 12 on which a protrusion 14 is formed, that is the right side of the connector of FIG. 1, a curved portion 20 of small radius is formed. The upper part of this curved portion is formed as a pre-load portion 21. The extension of the pre-load portion 21 extends in an inclined manner in a direction away from the side of the connector where the protrusion is formed. The upper part of this inclined portion is formed as a contact portion 22 of larger radius. The strip terminates at contact portion 22. The contact portion 22 is the portion of connector 11 which makes electrical contact with a conductive member in an insulator head that ifts into socket 6.

Insulator block or socket 6 for receiving electrical connectors 11 described above is formed of an insulating plastic material as a one piece structure. Block 6 has a sufficient transverse width or thickness to receive matching pairs of connectors, each arranged to face the other, and is elongated in a lateral direction. A groove 7 is formed centrally of the block to extend laterally, into which extend a series of holes or slots 1 for receiving the individual connectors 11. These connector receiving holes or slots extend through block 6 and between laterally spaced generally vertical partitions 8. The depth of groove 7 is set so that the groove extends downwardly from the upper part of block 6 for a distance which is slightly greater than one half the total height of the block. The upper part of the groove 7, as viewed in FIG. 1, opens in a manner expanding outwardly and upwardly to define a socket to receive a male connector head having contact members adapted to contact connectors 11 at contact portions 22. At the lower portions of open groove 7 there is formed an integral guide member 5 having an inverted triangular cross-section shape. The guide member is between partitions 8. Upper transverse side portions of guide member or element 5 are cut off in a vertical direction generally perpendicular to the bottom of insulator block 6 to present flat surface 5' in holes or slots 1. In each slot 1 there is provided a projection 9 between partitions 8 at a location opposite to the upper half of the guide member 5. Projections 9 are inclined downwardly toward the center of insulator block 6. At a location adjacent a projection 9 and on each side of a slot 1 there is formed into the side of the partitions connector receiving slot 10. Shoulders 15 of a connector 11 extend into spaced slots 10, each of which is formed as a rectangular parallelepiped extending upwardly from the bottom of the insulator block. The end surface of a projection 9 and the side walls of the slots 10 farthest from the guide member 5 are flush so that they are in the same plane. This plane stabilizes the position of boss or tab 12 of a connector 11. The upper walls or ends 2 of spaced slots 10 engage shoulders 15 of an entering connector to locate the connector vertically in hole or slot 1. Projection 14 includes a sharp cutting edge which digs into the surface of projection 9 in the common plane to prevent inadvertent removal of an assembled connector as shown in FIG. 2. Consequently as the connector is forced into hole 1 with the outer edges of flat boss 12 sliding in receptacle slots 10, the connector is attached to the insulator block in a preselected desired position.

At a lower part of the side of insulator block 6 parallel to the groove 7, there are formed a series of laterally spaced slots 4 forming clearance openings for insertion of spaced claws or an assembly jig to be described below. These clearance openings extend into slots 1 below partitions 8. Shoulders 15 of each connector 11 abut tops or ends 2 of slots 10, and a side wall of slot 10 forms connector retainer 3 for retaining the connector 11.

In assembling the electrical connector 11 to insulator block 6, connector 11 is inserted, with the contact 22 leading the way, into a hole or slot 1 from below the insulator block as seen in FIG. 1. At this time, the preload portion 21 of the connector abuts a side of the guide 5 to permit natural insertion of the upper part of the connector. Contact portion 22 moves upwardly within the hole 1 without damaging the connector 11. At this stage, the rectangular portion 12 may be held by a jig or tool to facilitate the insertion into block 6. As the connector is forced further into the block, rectangular portion 12 enters into slots 10 of the insulator block 6. When the shoulders 15 of the connector 11 abut the tops 2 of the slots, complete insertion of the connector has been accomplished. While connector 11 is being inserted into a hole 1 of block 6, as explained above, protrusion 14 of connector 11, which has a sharp edge, cuts into the body of the insulator block to secure the connector firmly engaged with the insulator block. Connector 11 in the assembled position within the insulator block is shown in FIG. 2. The pre-load portion 21 of the connector 11 abuts the flat surface 5' of the guide member 5 of insulator block 6, and the upper part of the rectangular portion 12 of the connector abuts the end surface of the projection 9 to retain the connector in a stable position.

Figure 3:
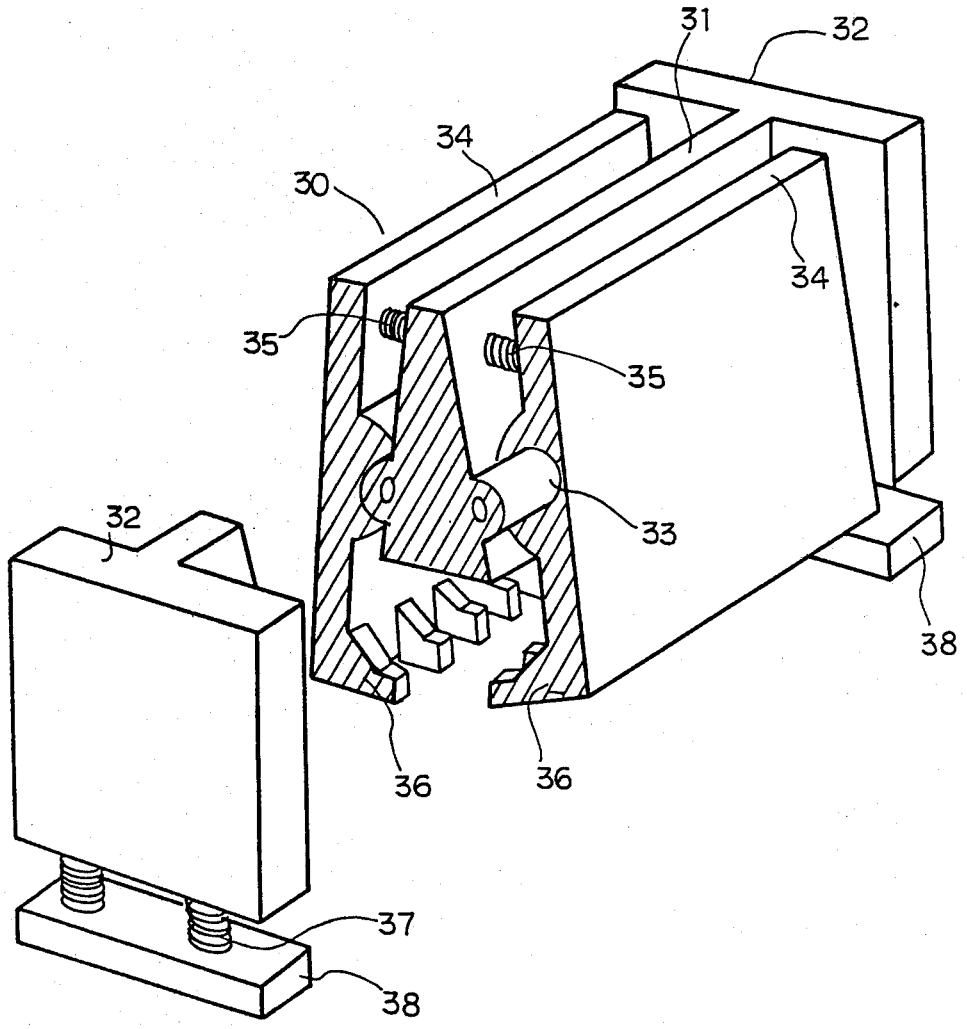

The connector assembly with the connectors 11 assembled into insulator block 6 is then attached to a printed circuit board in many applications. To accomplish this assembly operation, in accordance with the invention there is provided a jig 30 to be used in a manner which will be explained with reference to FIG. 3. The fitting or attaching jig 30 comprises a pair of end walls 32, connected by a central laterally extending wall 31. The central wall has a structure which increases its thickness downwardly, as seen in the drawing, and the height of wall 31 is about $\frac{2}{3}$ of the height of the end walls 32 to form a space below wall 31. Near the lower end of the central wall 31 at each side, there is formed a laterally extending projection 33 having a semi-circular cross-section. A pair of fitting or attaching walls 34 are provided at each side of the central wall 31. Walls 34 are biased away from the central wall 31 by springs 35 provided at a location above the projections 33. The inwardly facing surfaces of fitting walls 34 are provided with laterally extending recesses designed so as to allow projections 33 to be received therein so that walls 34 can pivot with respect to central wall 31. A series of inwardly projecting claws 36 are provided at the lower part of the fitting walls 34. The distance between the claws 36 is set to match the arrangement of slots 4 of insulator block 6. Side walls 32 are connected to each of two spaced lower bases 38 by springs 37. In FIG. 3, the jig or tool 30 is shown with the upper part of the walls 34 slightly pressed toward each other which moves claws 36 outwardly toward the clearance position.

In fitting or attaching the connector assembly to a printed circuit board 40, as shown in FIG. 2, the upper portions of the fitting walls 34 of jig 30 are pressed toward each other to maintain the lower portions of the walls in an open position. Next, the connector assembly is placed between fitting walls 34 of jig 30 which are in an opened position. Claws 36 of the jig are then inserted into the slots 4 of the block 6. The dimensions of the insertion holes 13 of the rectangular portion 12 of the connectors are so designed in shape and size to permit complete insertion of the end portions of the claws 36. By the prior selection of the lateral spacing of connectors 11, the interval and arrangement of partitions 8 of insulator block 6 and the size and arrangement of slots 4, the end portions of claws 36 accurately fit the holes 13 of a series of connectors assembled in block 6. After confirming that such a fitting is achieved, the force applied to the upper portions of the walls 34 of jig 30 is released. The lower portions of walls 34 are forced toward each other by action of springs 35 and walls 34 are positioned in generally parallel relationship. The arrangement of walls 34 at this time is shown in FIG. 2.

Next, in fitting or attaching the connector assembly held in fitting jig 30 by claws 36 to printed circuit board 40, it will be determined that bars 18 of the connectors are accurately aligned with the through holes 41 of printed circuit board 40. Then the upper part of the walls 34 of the jig are pressed down. Thereupon, the fitting walls 34 and side walls 32 are forced toward lower bases 38 against the action of springs 37. This forces bars 18 into holes 41. Spring portion 17 is forced into the holes slightly to provide a tight connection. The upper parts of the fitting walls 34 are then pressed toward each other. This releases claws 36 from holes 13 into which the claws were fitted. After confirming that the claws 36 are completely out of the slots 4, the jig 30 is removed from the connector assembly, leaving the assembly fitted and attached to printed circuit board 40.

As will be understood from the above described procedure, connectors 11 according to the present invention are each formed with the rectangular portion or boss 12 having insertion hole 13 to which a claw 36 of jig 30 is inserted. When fitting the connector assembly to the printed circuit board, an insertion force is applied to connectors 11 along the axis of the connectors. The insertion force is applied at or near insertion holes 13. Because of this, connectors 11 are accurately connected to the printed circuit board and any deformation of, or damage to, the connectors due to imbalance of insertion forces is avoided.

Insulator block 6 is provided with the guide member 5 and the connector retaining portions 3 so that insertion of connectors 11 into the contact receiving hole of the printed circuit board is done without any damage to the connectors. Shoulders 15 of the connector are received in the slots 10 with the protrusion 14 of each connector cutting into the body of the insulator. All of these features ensure that the connectors are accurately and firmly secured in the insulator block. In addition, there is provided the slots 4 through which claws 36 of the jig 30 enter to fit into the holes 13 of the connectors. In case all connectors are not accurately received in the insulator block, the claws 36 do not fit in the holes 13 which will prevent further operation of fitting jig 30. This means that the misalignment of any connector 11 can immediately be detected. In other words, if fitting jig 30 operates normally, it indicates that the connectors 11 are accurately arranged in the insulator block for accurate insertion into the holes 41 of board 40.

The ends of claws 36 have a shape matching the shape of holes 13 to provide accurate aligning of the connectors with respect to the driving claws.

Having thus described the invention, the following is claimed:

1. In an elongated electrical connector for insertion into an aperture of a printed circuit board and adapted to be fitted into a connector opening in an insulator block, said connector being stamped from a sheet metal blank and comprising: a flat intermediate portion having an insertion hole therethrough and upwardly facing abutment shoulders thereon to limit insertion of said connector into said insulator block; a spring portion below the said intermediate portion for engaging in said aperture of a printed circuit board, said spring portion extending downwardly to define a printed circuit board connecting bar having a generally rectangular cross-section with a lateral width slightly smaller than the width of said intermediate portion; a protrusion having a sharp edge formed on one side of said intermediate portion at an upper middle position thereof; said connector opening having a wall parallel to said flat intermediate portion and said protrusion being separate from said shoulders and engaging said wall of said connector opening to retain said connector in said insulator block; an upper half formed as a strip like portion having a lateral width smaller than that of the intermediate portion, said upper strip like portion extending upwardly from said intermediate portion and formed into a first curved portion hasving a first small radius at the side of the connector where said protrusion is formed to present a preloaded portion, said preload portion extending upwardly in a direction away from the side of the connector where said protrusion is formed to offer a contact having a second large radius greater than said small radius.

2. An electrical connector for press fitting as defined in claim 1 wherein the shape of said insertion hole in said intermediate portion is polygonal and is centrally located in said intermediate portion.

3. An electrical connector for press fitting as defined in claim 1 wherein said spring portion includes an enlarged portion having a lateral width smaller than that of said intermediate portion and is formed between said intermediate portion and said bar.

4. An electrical connector for press fitting as defined in claim 3 wherein a circular or oval hole is formed substantially at the central part of said enlarged portion.

5. A one-piece insulator block for receiving a number of elongated electrical connectors, said block being formed of an insulating plastic material and comprising: a lateral groove in the central part thereof and a series of partitions formed internally along opposite sides of said groove to define therebetween connector receiving slots at opposite sides of said groove; an inverted triangular cross-section guide member protruding from said partitions and between said opposite sides; said guide member being formed in the lower part of said groove and having side portions cut off in a vertical direction generally perpendicular to the bottom of said block; opposed projections in said slots and inclined downwardly in a direction toward the middle of said block between the partitions at a location facing said guide member; a rectangular parallelepiped shaped slot extending upwardly from the bottom of the insulator block and in each said partitions at a location adjacent said projections; an end surface of said projection and the side of said parallelepiped shaped slot farthest from the guide member being coplanar; and, a series of openings between said partitions in said block and intersecting said plane, said connector receiving slots extending along said block in a direction parallel to said groove.

6. An elongated, sheet metal electrical connector for insertion into an aperture of a printed circuit board and adapted to be carried by an insulator block, said connector comprising; a first elongated axially straight portion adapted to be pressed into an aperture in a printed circuit board; a second elongated portion forming an electrical contact element; and an intermediate portion between said first and second elongated portion, said intermediate portion including an enlarged generally flat member and abutment means for limiting insertion movement of said connector into an aperture therefor in said insulator block, an opening peripherally continuous through said flat member and adapted to be engaged by an external element employed in inserting said connector into said aperture of said insulating block, and a protrusion separate from said abutment means and projecting from said flat member for cutting into said insulating block to prevent inadvertent dislodging of said connector.

7. A connector assembly for attachment to a printed circuit board, said assembly including a number of elongated, sheet metal electrical connectors and an insulator block; said block including a row of connector receiving channels therein each having a connector entrance end; means coacting between said connectors and said channels for securing said connectors in a generally straight path in said block; said block having a plurality of access ports each extending laterally into said block and intersecting a corresponding one of said channels along the entrance end thereof; and each of said connectors having a peripherally closed aligning and driving opening therethrough aligned with the corresponding access port and exposed therethrough to receive a drive member for inserting the connector into said channel in the direction from said entrance end thereof.

* * * * *